United States Patent [19]

Lombardi et al.

[11] 4,051,639

[45] Oct. 4, 1977

[54] REMOVABLE DECK FOR A BUILDING STRUCTURE INTERSTITIAL SPACE

[75] Inventors: Jack P. Lombardi, Manlius; Francis T. Lombardi; Tarky J. Lombardi, Jr., both of Syracuse, all of N.Y.

[73] Assignee: Syracuse Tank & Manufacturing Co., Inc., Syracuse, N.Y.

[21] Appl. No.: 718,022

[22] Filed: Aug. 26, 1976

[51] Int. Cl.[2] ..... E04B 1/343

[52] U.S. Cl. ..... 52/64; 52/127; 52/177

[58] Field of Search ..... 52/22, 64, 73, 74, 78, 52/90, 127, 177, 234, 236, 238, 243, 633, 634, 645

[56] References Cited

U.S. PATENT DOCUMENTS

| | | | |
|---|---|---|---|
| 3,258,282 | 6/1966 | Koenigshof | 52/127 X |
| 3,272,269 | 9/1966 | Murphy | 52/64 X |
| 3,336,717 | 8/1967 | Ward et al. | 52/645 |
| 3,415,027 | 12/1968 | Snyder et al. | 52/127 X |
| 3,890,750 | 6/1975 | Berman et al. | 52/127 |

*Primary Examiner*—J. Karl Bell

*Attorney, Agent, or Firm*—Bruns & Jenney

[57] ABSTRACT

A removable deck for an interstitial space between stories of a building has joist saddles adapted to be permanently secured to building truss members in the interstitial space, each saddle having a socket into which the end of a joist may be dropped. The joists are channel type members of a length equal to the space between trusses. Each joist has an upturned flange at its top and the deck members, of a chosen length to extend across selected number of joists, have slots across their bottoms for close engagement with the upturned flange of the joist. The joists have a strip of rubber-like material along their upper surfaces and the upturned flange has dimple-like projections spaced therealong for holding sidewise movement of the deck members to a minimum. Each deck member is of inverted channel shape, the upper surface of which is longitudinally slitted to provide good air circulation. The dimpled projections of the joist flanges are also spaced so as to allow the deck members to be narrowly spaced apart to provide more air circulation. The joists and deck members are formed of light-gage steel so as to be easily handled by a single worker.

3 Claims, 6 Drawing Figures

REMOVABLE DECK FOR A BUILDING STRUCTURE INTERSTITIAL SPACE

BACKGROUND OF THE INVENTION

This invention relates generally to removable decking providing access to machinery and duct work installed in the interstitial space between the ceiling of one stroy of a building and the floor structure of the story immediately above that ceiling. More particularly, it relates to a floor or deck whose joists and deck members do not interfere with air-circulation in the interstitial space and which can be easily completely removed for installation of additional machinery and then can be easily replaced in position.

Building structures, particularly those for hospitals, are now being provided with comparatively large interstitial spaces, particularly above operating rooms and laboratories, in which large machinery, such as generators or the like can be installed or in which ducts and pipes and other equipment are installed which require maintenance and repair.

Prior art platforms or cat walks, providing access to such machinery or duct works installed in the interstitial space require large steel structural members such as joists and decking which may interfere with air circulation required by building codes for such spaces or are cumbersome and difficult to remove and are even more difficult to replace after repair work has been completed.

SUMMARY OF THE INVENTION

This invention contemplates the provision of relatively small joist saddles which can be permanently secured, as by welding or otherwise, to the buildings trusses extending in the interstitial space. Lightweight steel joists, supported at each end in the joist saddles then span the distance between trusses at four foot intervals and steel decking members are removably secured on the joists.

The joists can be easily removed from their sockets in the saddles by simply lifting them out. The joist decking members have their upper surface slitted for providing air circulation and traction for the workers moving thereupon and they are narrowly spaced apart affording further air circulation.

The joists are lightweight channel members with an upturned flange at their tops and the lightweight steel deck members are also inverted channel members. The deck members are slotted at 4 foot intervals across their vertically extending flanges and across the inturned reinforcing flanges at their bottoms to narrowly contain the upturned flange of the joist. A strip of rubber-like plastic-resin material such as "Neoprene" is provided along the top of each joist adjacent the upturned flange to deaden noise caused by workers walking on the decking and to inhibit sidewise slipping of the deck members and the strip is preferably secured, as by adhesive, to the joist to prevent loss of the strip where the joists are installed or removed. In addition, the joist upturned flanges are provided with projecting dimples, formed by staking or otherwise, at small intervals to further prevent all but minimal sidewise movement of the deck members on the joists.

Due to the relatively short length of the joists and deck members, workers can easily remove these members and pile them up to one side and due to their lightweight construction, one man alone can easily replace them when repair and installation work is completed. Due to the channel construction of the joist and deck members, the completed deck can support a 55 lb. per square foot load.

DESCRIPTION OF THE PREFERRED EMBODIMENT

Figure 1:
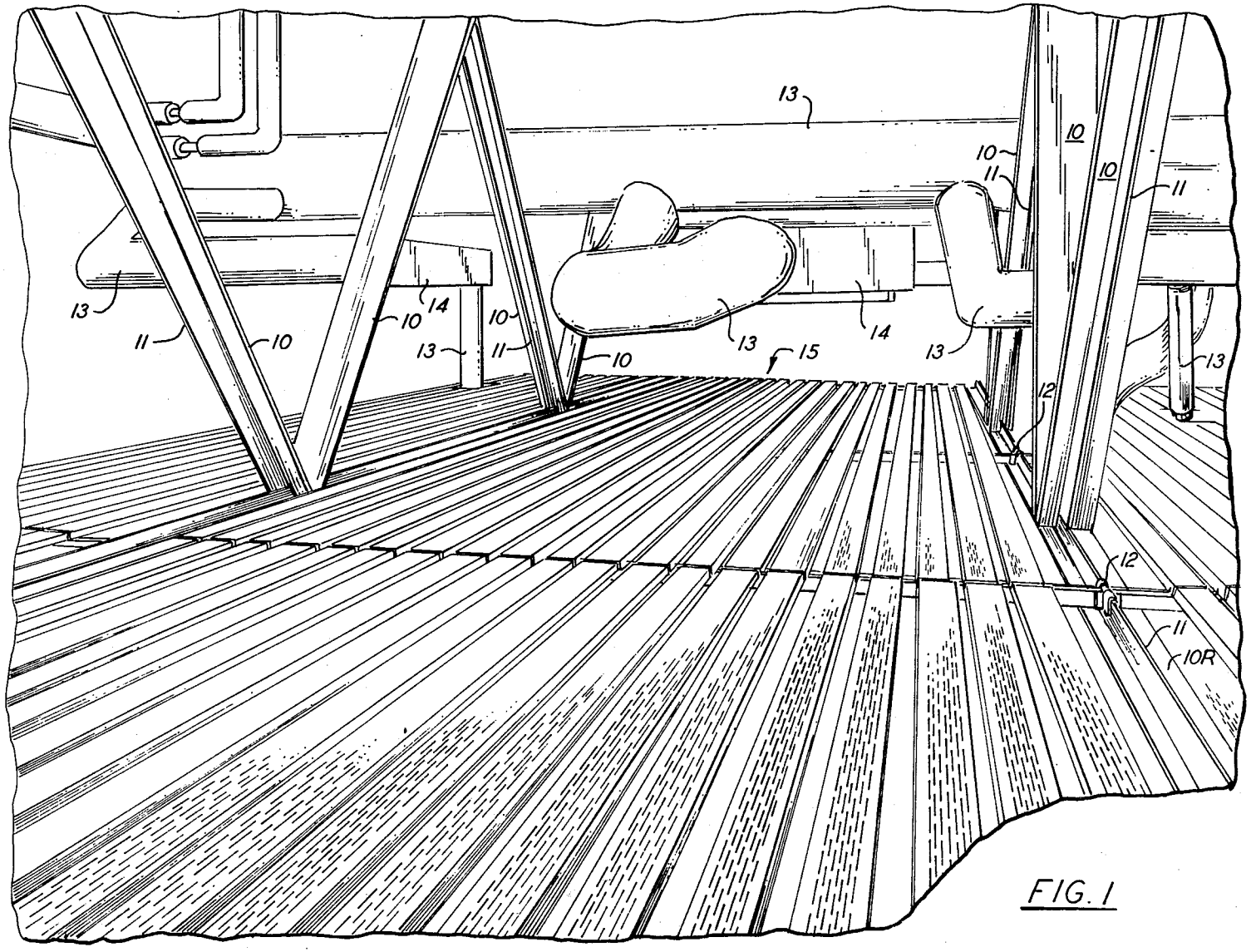
FIG. 1 is a perspective view of a deck according to the invention showing building trusses, duct-work, and machines thereabove.

Referring to FIG. 1, a portion of an interstitial space is shown with two rows of the building trusses 10 shown. These trusses are in the form of T-beams with projecting flanges 11. The upwardly projecting flange 11 of the (horizontally extending) inverted T truss 10R is clearly shown at the right of FIG. 1 connecting the lower (or intermediate) ends of the other trusses shown. Also shown at the right are two joist saddles 12 secured to the flange 11 of truss 10R and various ducts 13, of various sizes and shape, and machines 14 supported by means, not shown, in the interstitial space.

The aisle 15 shown at the center of FIG. 1, comprising decking, hereinafter described, extends for a length which may be as long as 55' between the two rows of trusses which have upwardly projecting flanges 11 spaced apart by 10 feet. Other aisles to the right and left of aisle 15 are similarly decked.

Figure 2:
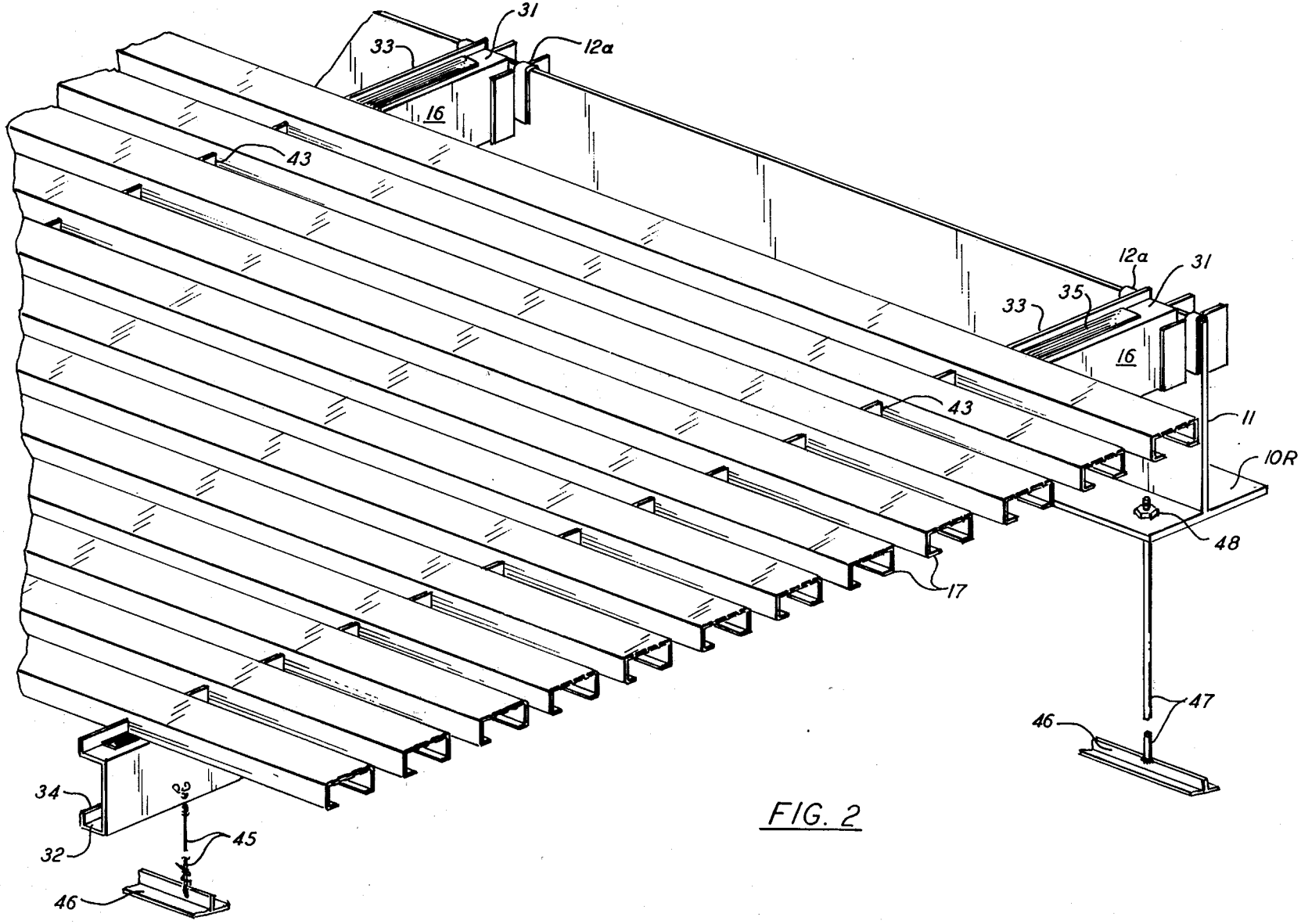
FIG. 2 is a cut-away section of a deck showing a horizontally extending saddle members, joists and deck members.

Referring to FIG. 2, an incomplete section of decking is fragmentarily shown, including a horizontally extending inverted T-truss 10R, joist saddles, joist members 16, and flooring members 17.

Figure 3:
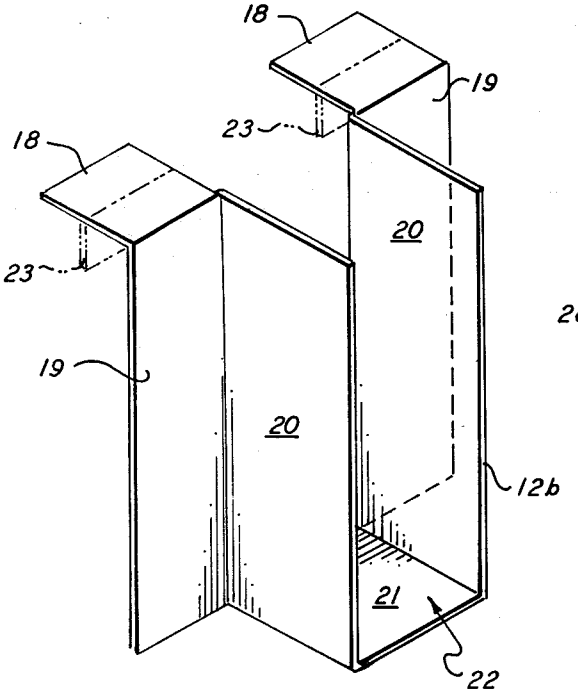
FIG. 3 is a perspective view of a joist saddle before installation.

Referring now to FIG. 3, a joist saddle 12C is shown as having horizontal top portions 18 adapted to lie on top of an I-beam truss, integral vertically extending suspending sections 19 which have integral outwardly-bent socket-forming sections 20, the sections 20 being joined at their bottom edges by an integral, horizontally bent section section 21, the sections 20 and 21 forming the joist-supporting socket-portion 22 of the saddle.

It will be apparent that the top portions 18, may have their outer ends bend downward to form a flange indicated in broken lines at 23 for forming a closure in engagement with the top of the upwardly-projecting flange 11 of the inverted T-beam truss 10R shown in FIG. 2. It will also be apparent that the downturned flanges 23 may be extended to form suspending sections 19, with integral out-turned sections 20 joined at their bottom edges by an integral horizontal section 21 for forming another socket portion 22 which is the mirror image of hanger **12*b* shown in FIG. 3. Such saddle structures are shown at 12*a*** in FIG. 2.

Figure 4:
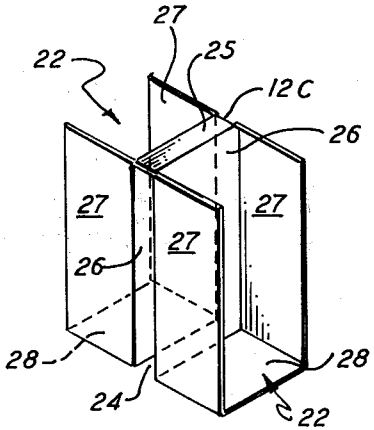
FIG. 4 is a perspective view on a smaller scale of an alternative form of joist saddle.

Referring to FIG. 4, an alternative form of saddle structure 12C is shown forming socket portions 22 on either side of the upwardly extending flange 11 of the truss member 10R shown in FIG. 2 when the slot 24 is slipped down over the flange 11. The upper portion of slot 24 is bridged by the integral section 25 having downward portions 26 integral with side members 27 and bottom members 28 forming the oppositely facing sockets 22.

It will be apparent that other joist saddle members may be formed and secured as by welding, where desired, to various truss-members so long as the saddle member has an upwardly opening and a laterally projecting and opening socket 22 for supporting a joist end.

Figure 5:
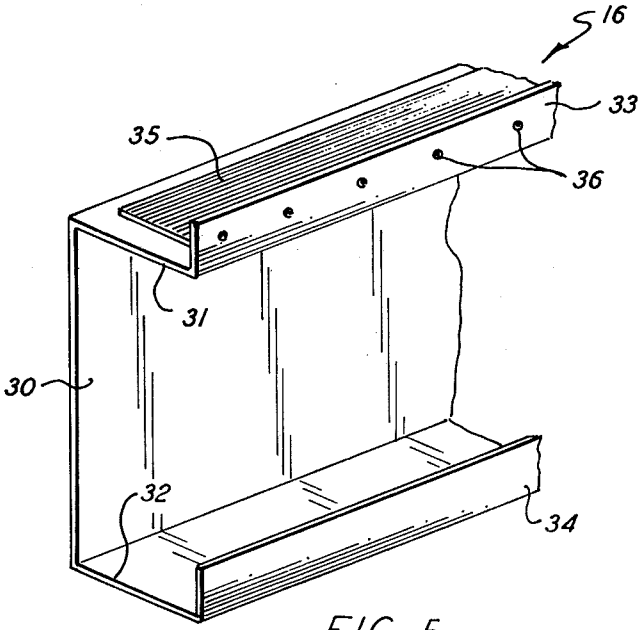
FIG. 5 is a fragmentary perspective view of a joist member.

Referring now to FIG. 5, a joist 16 is fragmentarily shown as being generally channel-shaped with a comparatively long vertically-extending flange or web 30 and comparatively shorter upper and lower flanges 31 and 32. The upper and lower flanges 31 and 32 have, respectively, upwardly turned reinforcing flanges 33 and 34. It will be apparent hereinafter that the upper flange 31 may have a downwardly turned reinforcing flange like flange 34 of the lower flange 32 and the upwardly turned flange 33 may be provided by an angle welded to the top flange 31.

On the upper surface of flange 31 an elongated strip 35 of "Neoprene" rubber is provided for sound-deadening and for preventing slippage of the deck members 17, hereinafter described. Strip 35 is preferably secured by adhesive to flange 31 to prevent its loss when the joist 16 is handled. Flange 33 is provided with a plurality of spaced and projecting dimples 36, formed by staking or otherwise, along its length, for a purpose to be described.

Figure 6:
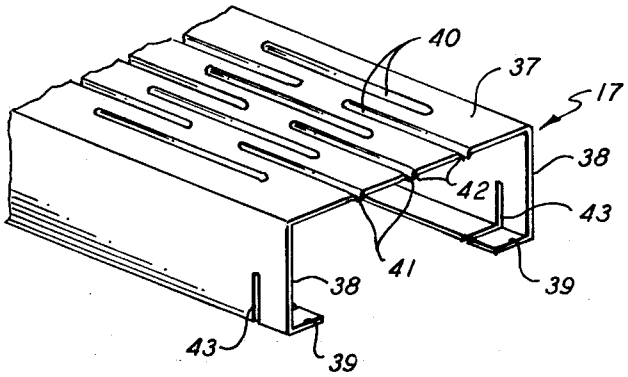
FIG. 6 is a fragmentary perspective view of a deck member.

Referring now to FIG. 6, a deck-member 17 is fragmentarily shown as being generally channel shaped with a comparatively wide upper flange or web 37 and comparatively shorter, vertically disposed side flanges 38, each of which terminates at its bottom in an inturned reinforcing flange 39.

The upper surface 37 of each deck member is slitted, as shown, each slit comprising a rounded depression 40, typically 2½ inches in length, each depression terminating at its bottom in a slot 41 entirely through the web 37 between downturned edges 42, as shown, at the bottom of the depressions 40. The slots 41 are spaced on 1/32 inch centers transversely, and the depressions 40 are spaced alternately longitudinally, as shown, the depression 40 of one row starting approximately at the middle of the transversely adjacent depression 40, for maximum strength of the upper web 37.

The bottom flanges 39 and side flanges 38 are slotted at 4 foot intervals (see FIG. 2) at 43, each slot 43 being substantially equal in width to the thickness of flange 33 of the joist and extending upward in side flange 38 for a distance at least equal to the height of the top of flange 33 above strip 35. The dimples 36 in flange 33 project outward from the flange so that flange 33 at each dimple cannot pass through the slot 43 in the deck member.

Dimples 36 are spaced transversely on two inch centers, for example, and each deck member 17 has an overall width of 3½ inches. Designating the dimples 36 shown in FIG. 5 as *a, b, c, d* and *e* from left to right and referring to flanges 38 as left leg or right leg as viewed in FIG. 6, the spacing may be described as: when the left leg of a deck member is inserted between dimples *a* and *b,* the right leg must be inserted between dimples *b* and *c.*

The distance between centers of *a* and *c* is 4 inches but the dimples themselves occupy space, found in practice to be at least ¼ inch for each dimple. The distance between dimples *a* and *c* is therefore 3-¾ inches at most, thus leaving the deck member, which is 3½ inches wide, only ¼ inch space in which to shift sideways which is a minimal distance.

Furthermore, the left leg of the adjacent deck member on the right, when it is inserted between dimples *d* and *e,* and the right leg inserted between dimples *e* and *f,* to the right thereof, is similarly limit to a minimal sidewise shift, leaving the spacing between the two deck members of about 2½ inches at most. This spacing is also important for allowing air-passage through the deck as required by many building codes.

Referring again to FIG. 2, the deck members 17 and joists 16, as well as the joist saddles 12, are made of 16 ga. steel, making the first two members light and easily handled. The joists are typically 10 feet long and the deck members are typically 12 feet long, making the latter substantially equal in weight to the joists.

In construction, the joist saddle members are precisely assembled at 4 foot intervals along the flanges 11 of the joist members and are then welded in position. The joists 16 are then dropped into the opposite sockets 22 of the fixed saddles and then the deck members 17 are secured in position by positioning the slots 43 over the flange 33 of the joist and forcing the deck members down into contact with the strips 35 of the joists, the deck members extending from the center of top 31 of one joist 16 to the same center of a joist 12 feet away. For disassembly the opposite procedure is followed, the saddles 12 remaining in position.

As shown at the left in FIG. 2, the ceiling of the story below the interstitial space may be hung by a plurality of 12 ga. hanger wires 45 attached along each joist 16 at intervals by drilling a hole in the bottom flange 32 adjacent the flange 34 and tying the wire in the usual manner to the joist. The lower end of the wire is similarly tied to the upwardly extending flange of a small inverted T-bar 46 fragmentarily shown. T-bars 46 may also be supported below truss-beam 10R by a small rod 47, whose upper end, passing through an appropriate hole in the truss 10R is secured by an appropriate nut 48. The lower end of the rod 47, shown at the right in FIG. 2, may be secured, as by welding or other wise, to a similar inverted T-bar 46.

It will be apparent that the ceiling of the floor below may, in some cases, be of more conventional construction. The deck floor of the interstitial space above such conventional ceiling or such a hung ceiling may also be of more conventional construction as, for example, when a heavy-duty welded-steel floor is desired for supporting such heavy machinery as large generators and the like and decking, such as that shown in FIG. 2, may be provided adjacent to such a heavy-duty floor to provide an opening, when the decking is removed, for installation and removal of the heavy machinery.

We claim:

1. A removable deck for an interstitial space in a multi-storied building between the ceiling of one story and the floor of the story immediately thereabove, which space contains two spaced and parallel rows of building trusses, each row having at the same level at least one row of horizontally extending truss portions; comprising: a plurality of joist-saddles secured to the horizontal truss portions at spaced intervals therealong, the saddles of one row being transversely precisely opposite to the saddles of the other row of trusses, each saddle having an upwardly open and transversely projecting and opening socket position adapted to contain therein the end portion of a joist member, each joist being equal in length to the space between the horizontal truss portions of the two rows and being generally channel-shaped in cross section, each joist having a flat horizontally-extending upper surface and an upwardly projecting flange therealong, a strip of rubber-like material extending along each joist top surface adjacent the joist flange, and a plurality of generally inverted-channel-shaped deck members of chosen equal lengths extending across a plurality of joists from the center of one joist upper surface to the center of another joist upper surface, each deck member having an upper web surface slitted to provide air circulation therethrough and traction for workers walking thereon, each deck member having vertically extending side flange portions for resting on the joist top surfaces, each deck member having slots in the side flanges thereof extending from the side flange bottoms upward at least a distance equal to the distance that the upwardly projecting flanges of the joists extend above the rubber like strip on the joist top surfaces, whereby the joist ends may be dropped into the sockets of the saddles and lifted therefrom and the deck members placed across a plurality of joists with the slots of the deck side flanges fitted over the joist upwardly projecting flanges and lifted therefrom, while the saddles remain secured to the horizontal truss portions.

2. A removable deck for an interstitial space in a multi-storied building between the ceiling of one story and the floor of the story immediately thereabove, which space contains at least two spaced and parallel rows of building trusses, each row having at the same level at least one row of horizontally extending truss portions; comprising: a plurality of metal joist saddles secured to the horizontal truss-portions at spaced intervals therealong, the saddles of one row being transversely precisely opposite to the saddles of the other row of trusses, each saddle having an upwardly open and transversely projecting and opening socket portion adapted to contain therein the end portion of a joist member, each joist being equal in length to the space between the horizontal truss portions of the two rows and being of light gage metal generally channel-shaped in cross section; each joist having an upright web portion, and horizontally extending upper and lower flange portions terminating in an upwardly projecting reinforcing flange therealong; a strip of rubber-like material extending along and secured to each joist top surface adjacent its upwardly projecting reinforcing flange, and a plurality of generally inverted-channel-shaped deck members of light gage metal the deck members being of chosen equal lenths substantially equal in lenth to the joists for extending across at least three joists and extending from the center of one joist upper flange to the center of another joist upper flange, each deck member having an upper web surface slitted to provide air circulation therethrough and traction for workers walking thereon, each deck member having vertically extending side flange portions each terminating in an inturned reinforcing flange therealong at its bottom for resting on a joist upper flange, each deck member having spacing slots through the side flanges and reinforcing flanges thereof extending upward from the bottom of the deck member a distance at least equal to the distance that the upwardly projecting flange of joist top flange extends above the rubber-like strip on the joist top surface, the width of the deck member spacing slots being substantially equal to the thickness of the upwardly projecting reinforcing flange of the joist upper flange, the spacing of the deck member spacing slots being equal to the spacing of the joists in their sockets along the horizontally extending truss portions.

3. The removable deck defined in claim 2 wherein the joist upper flange upwardly projecting reinforcing flange has a row of narrowly spaced projecting dimples therealong; the dimple spacing being such that, when a deck member is placed on a joist with a deck member spacing slot containing a joist upwardly projecting reinforcing flange therein, the side flange on one side of the deck member is narrowly spaced from one dimple on that side and the side flange on the other side of the deck member is narrowly spaced from another dimple on that other side, whereby sidewise movement of the deck member is limited to minimal movement, and where another deck member is similarly placed on a joist with its adjacent side flange between two dimples whose nearest dimple is spaced from the adjacent dimple of the first deck member, the deck members are narrowly spaced a distance substantially equal to the dimple spacing.

* * * * *